US008932540B2

(12) United States Patent
Den Toonder et al.

(10) Patent No.: US 8,932,540 B2
(45) Date of Patent: Jan. 13, 2015

(54) DEVICE AND METHOD FOR TRANSPORTING MAGNETIC OR MAGNETISABLE BEADS

(75) Inventors: Jacob Marinus Jan Den Toonder, Eindhoven (NL); Pieter Jan Van Der Zaag, Eindhoven (NL); Hao Chieh Chao, Maastricht (NL)

(73) Assignee: Koninklijkle Philips N.V., Eindhoven (NL)

( * ) Notice: Subject to any disclaimer, the term of this patent is extended or adjusted under 35 U.S.C. 154(b) by 154 days.

(21) Appl. No.: 13/395,321

(22) PCT Filed: Sep. 6, 2010

(86) PCT No.: PCT/IB2010/053991

§ 371 (c)(1),
(2), (4) Date: Mar. 9, 2012

(87) PCT Pub. No.: WO2011/030272

PCT Pub. Date: Mar. 17, 2011

(65) Prior Publication Data

US 2012/0171085 A1 Jul. 5, 2012

(30) Foreign Application Priority Data

Sep. 11, 2009 (EP) ..... 09170085

(51) Int. Cl.
*B01L 99/00* (2010.01)
*B03C 1/034* (2006.01)
(Continued)

(52) U.S. Cl.
CPC ..... *B03C 1/034* (2013.01); *B01L 3/502761* (2013.01); *B03C 1/0335* (2013.01); *B03C 1/24* (2013.01); *B01L 2200/0668* (2013.01); *B01L 2400/043* (2013.01); *B03C 2201/18* (2013.01)
USPC ..... 422/500; 210/222; 210/695

(58) Field of Classification Search
CPC ..... B01L 2200/0652; B01L 2200/0668; B01L 2400/043; B03C 1/0335; B03C 2201/18
USPC ..... 210/695, 222
See application file for complete search history.

(56) References Cited

U.S. PATENT DOCUMENTS 5,655,665 A 8/1997 Allen
6,716,642 B1 4/2004 Wu
(Continued)

FOREIGN PATENT DOCUMENTS

EP 1462173 A1 9/2004
EP 1462174 A1 9/2004
(Continued)

OTHER PUBLICATIONS

Suzuki, Hiroaki et al "A Chaotic Mixer for Magnetic Bead-Based Micro Cell Sorter", Journal of Microelectromechanical Systems, vol. 13, No. 5, Oct. 2004.

*Primary Examiner* — Paul Hyun

(57) ABSTRACT

A device for transporting magnetic or magnetizable beads over a transport surface includes a chamber holding magnetic or magnetizable beads in a fluid, a transport element including the transport surface within the chamber, and a current wire structure including at least two sets of meandering current wires arranged on a side of the transport element opposite to the transport surface. The at least two sets are displaced with respect to each other in at least two directions. A switching unit switches currents individually applied to the sets of current wires according to a current driving scheme resulting in a transport of the beads over the transport surface.

13 Claims, 11 Drawing Sheets

(51) Int. Cl.

| | |
|---|---|
| ***B01L 3/00*** | (2006.01) |
| ***B03C 1/033*** | (2006.01) |
| ***B03C 1/24*** | (2006.01) |

(56) References Cited

U.S. PATENT DOCUMENTS

| | | | |
|---|---|---|---|
| 7,309,439 | B2 | 12/2007 | Fernandez |
| 2002/0048821 | A1 | 4/2002 | Storek |
| 2002/0106314 | A1 | 8/2002 | Pelrine |
| 2002/0166800 | A1 | 11/2002 | Prentiss |
| 2004/0262210 | A1 | 12/2004 | Westervelt |
| 2005/0284817 | A1 | 12/2005 | Fernandez |
| 2006/0102482 | A1 | 5/2006 | Auerswald |

FOREIGN PATENT DOCUMENTS

| | | | |
|---|---|---|---|
| WO | 03039753 | A1 | 5/2003 |
| WO | 2004078316 | A1 | 9/2004 |
| WO | 2008084245 | A2 | 7/2008 |

DEVICE AND METHOD FOR TRANSPORTING MAGNETIC OR MAGNETISABLE BEADS

This application is a National Stage Entry of PCT/IB2010/053991, filed Sep. 6, 2010, and published in English as WO 2011/030272 A1, on Mar. 17, 2011.

FIELD OF THE INVENTION

The present invention relates to a device and a corresponding method for transporting magnetic or magnetizable beads over a transport surface.

Further, the present invention relates to a micro-fluidic apparatus, in particular DNA sequencing apparatus, for manipulating a sample containing magnetic or magnetizable beads, in particular for sequencing or nucleic acid testing.

BACKGROUND OF THE INVENTION

It is known that magnetic particles ('beads') embedded in a liquid can be used to carry a probe molecule on their surface that specifically interacts with a complementary target molecule (for example single stranded probe DNA interacting with complementary target DNA). Upon reaction with a molecule to be probed and, for example, using optical or electrochemical measurements, one can determine the amount of target molecules on a bead or within a certain volume containing beads. The interest in using magnetic beads, is that they can be manipulated using magnetic fields irrespective of fluid motion. In this way one can create an important relative motion of the beads with respect to the fluid and, hence, a large probability of binding a target molecule to a probe molecule fixed on the bead surface. One can then magnetically extract the beads to a place of detection/collection. Historically, beads have been locally fixed by using external magnets or have been transported using mechanically moving external magnets. The latter procedure may be for example used to fabricate mixing devices and in immuno-assay methods.

Here and in the following, particles smaller than 100 microns are considered, which are often also called beads. The beads typically have a size in the range between 0.1 and 50 microns, e.g. in the range of 1 micron.

"Separation" of magnetic beads means that a liquid flow, containing the beads, passes a zone with a large magnetic field (gradient) and that the magnetic beads are filtered out (separated) by the field. Magnetic transport of beads is essential for bringing the beads to a well-defined position within a micro fluidic circuit, for example near to a magnetic bead detection device. "Transport" means that the beads are effectively moved by a magnetic force, i.e. using a magnetic field and not just retained by a magnetic field from a liquid solution passing by (=separation). Nevertheless, manipulation of these beads in general and transport in particular, is a difficult task, as the effective relative magnetic susceptibility of the (super)paramagnetic beads is rather weak (typically <<1, due to demagnetization effects of the mostly spherical particles) and the magnetic volume of the particles is small. This explains why mostly the large field of (mechanically moving) permanent magnets or large electromagnets have been used for the separation, transport, and positioning of magnetic beads. In other work, micropatterned conductors, actuated by large currents, have been demonstrated to present a useful solution for magnetic beads capture and transport. These devices allow precise positioning and transport over 10-100 μm distances in a single actuation event.

US 2005/284817 A1 discloses a device for transporting magnetic or magnetizable beads in a capillary chamber comprising a permanent magnet or an electromagnet for subjecting the capillary chamber to a substantially uniform magnetic field, to apply a permanent magnetic moment to the beads. At least one planar coil and preferably an array of overlapping coils are located adjacent to the capillary chamber for applying a complementary magnetic field on the beads parallel or antiparallel to said substantially uniform magnetic field, to drive the beads. An arrangement is provided for switching the current applied to the coil(s) to invert the field produced thereby, to selectively apply an attractive or repulsive driving force on the beads. The device is usable to transport beads for performing chemical and biochemical reactions or assay, as is done for instance in clinical chemistry assays for medical diagnostic purposes.

Since the NIH (National Health Institute) project to initiate the sequencing of the whole human genome at the end of the 1990's, the technological developments in sequencing technology have been going very rapidly. Especially since the introduction of 2nd generation of sequencing machines by 454 Life Sciences (now Roche) in 2005 (see M. Margulies, M. Egholm et al., Nature, 437 (2005) 376-380) developments have intensified. Currently, a number of other companies also have launched 2nd gen. sequencing machines, and it is the desire to reduce the costs of DNA sequencing further so that DNA sequencing will become a clinical tool in the analysis of, for instance, cancer.

One of the general strategies to reduce cost further is to miniaturize the sequencing devices, in particular by integration of the steps that are necessary for sequencing in a microfluidics device. In such an approach, the DNA to be sequenced as well as the reagents involved in the sequencing reactions, are manipulated within micro-channels and chambers of sub-millimeter dimensions. The manipulation can be done in various ways, such as with micro-pumps and valves, integrated micro-actuators, electrokinetic driving forces, magnetic driving forces, or by exploiting surface tension.

In some of the next-generation sequencing approaches, magnetic micro-beads are used a substrates for the DNA strands to be sequenced. In particular, ideally each single bead has one unique DNA strand attached to it, that is copied millions times on the same bead (using PCR). Typically, for multiplying the same strands many more times on a single bead in order to increase single to noise ratio emulsion bead PCR multiplications (emPCR) are used. When miniaturizing such an approach, it would be very advantageous to be able to manipulate the beads in a controlled way, using magnetic fields generated locally in the device. This would offer the opportunity to transport beads with specific strands attached to it to particular locations in the device, while monitoring their exact position.

SUMMARY OF THE INVENTION

It is an object of the present invention to provide a device and a method for transporting magnetic or magnetizable beads over a transport surface by which the number of electrical signals and connections needed for the generation of the forces is minimized, but which offers a great flexibility of bead manipulation.

In a first aspect of the present invention a device for transporting magnetic or magnetizable beads over a transport surface is presented, comprising:

- a chamber comprising magnetic or magnetizable beads in a fluid, a transport element including said transport surface within said chamber over which said beads shall be transported, a current wire structure comprising at least two sets of meandering current wires arranged on a side of said transport element opposite to said transport surface, said at least two sets being displaced with respect to each other in at least two directions, a switching unit for individually switching currents individually applied to said sets of current wires according to a current driving scheme resulting in a transport of said beads over said transport surface.

In a further aspect of the present invention a corresponding method is presented.

In a still further aspect of the present invention a micro-fluidic apparatus, in particular DNA sequencing apparatus, for manipulating sample containing magnetic or magnetizable beads, in particular for sequencing or nucleic acid testing is presented, comprising a device for transporting magnetic or magnetizable beads over a transport surface according to the present invention.

Preferred embodiments of the invention are defined in the dependent claims. It shall be understood that the claimed method and the claimed micro-fluidic apparatus has similar and/or identical preferred embodiments as the claimed device and as defined in the dependent claims.

The present invention is based on the idea to use a current wire structure of meandering current wires that are spatially displaced with respect to each other and that are driven using specific driving schemes to generate the magnetic forces driving the beads in a controlled way through the device. By use of the spatial displacement of the meandering current wires and the appropriate provision of driving currents, i.e. an appropriate switching of the currents provided to the individual meandering current wires, the direction and speed of movement of the beads can be achieved. In this way the number of electrical signals and connections needed for the generation of the forces are minimized, but a great flexibility of bead manipulation is achieved nevertheless.

The invention particularly enables the collective manipulation of super-paramagnetic beads over the transport surface along any desired trajectory. The structure comprises at least two pairs of meandering current wires, and requires only four electrical connections to realize complete freedom of bead movement. When applying the proper driving schemes, as proposed according to preferred embodiments, the beads can not only be moved along any path, but can also be forced to "hop" over the transport surface or jump between (micro-) wells within the transport surface.

The invention is useful for any (micro-fluidic) system in which beads need to be manipulated collectively over a surface in a controlled fashion. In particular, the invention can be applied in DNA sequencing devices to control the sequencing steps involved, as well as steps in sample preparation for nucleic acid testing. Further, the device, system or method according to the present invention can be used in a magnetic bio sensor used for several biochemical assay types, e.g. binding/unbinding assay, sandwich assay, competition assay, displacement assay, enzymatic assay, immuno-assay etc. Such a magnetic biosensor system or device can detect molecular biological targets. Note that molecular targets often determine the concentration and/or presence of larger moieties, e.g. cells, viruses, or fractions of cells or viruses, tissue extract, etc.

The transport element can be a separate element within the chamber, but it can also be a part of the chamber wall, i.e. the transport surface can also be an inner surface of the chamber wall. Further, the current wire structure can be placed within the chamber or outside the chamber, in particular if the transport surface is an inner surface of the chamber wall.

According to a preferred embodiment said sets of meandering current wires are substantially arranged in a wire plane parallel to said transport surface, in particular on the surface of said transport element opposite to said transport surface. Hence, the current wires are located as close as possible to the transport surface and the beads to be transported. While it is generally possible that the sets of meandering current wires are displaced in all three spatial directions, it is further preferred that the sets of meandering current wires are displaced in two orthogonal directions in said wire plane. Of course, short circuits between wires of different sets must be avoided so that at the crossing of wires of different sets appropriate measures for avoiding such short circuits are provided. For instance an insulating material is placed between the wires at those crossings, or one of the wires is locally displaced in the third direction at the crossing point to avoid a short circuit.

The size of the displacement depends on the size of the beads, the size of the wires and the current strength (respectively the force that shall be produced by the currents run through the current wires). Typical values for the displacement are 10 to 50 microns for a typical bead size of 1 micron. Generally, typical displacements are an order of magnitude larger than the bead size.

There are various embodiments for optimizing the bead transport. For instance, in one embodiment the current wire structure comprises at least three sets of meandering current wires arranged on a side of said transport element opposite to said transport surface, said at least three sets being displaced with respect to each other in at least two directions. In this way, a well defined direction of force on the beads can be achieved.

According to another embodiment the device comprises a stationary magnetic field generation means for generating a stationary, substantially uniform magnetic field in a direction substantially parallel to the transport surface, wherein said current wire structure comprises two sets of meandering current wires. The stationary and uniform external magnetic field can, for instance, be produced by an external permanent magnet or an electro-magnet structure (e.g. a coil structure).

The advantage of the three-sets configuration is that no additional external magnetic field needs to be generated to achieve complete flexibility of bead motion control. The advantage of the two-sets configuration is that the driving schemes and driving electronics is simpler. The advantage of the additional external field is that it increases the magnetization of the beads so that the bead velocities that can be achieved are about one order of magnitude larger than without the external field.

Depending on the kind of movement of the beads or the way in which they shall be manipulated over the transport surface, an appropriate switching scheme for switching the currents provided individually to the sets of current wires is adapted accordingly. They can, for instance, be fixed different switching schemes that can be chosen by the user, but it is also possible in an embodiment that the user has the freedom and options to individually modify the settings of the switching scheme and individually control the currents provided to the various sets of current wires. In the embodiment using an additional external magnetic field it is also possible that the user has the additional freedom to manipulate the strength and/or direction of the external magnetic field, for instance if an electromagnet is used for generating the external magnetic field.

A transport of beads over the transport surface in one direction is obtained with an embodiment according to which the switching unit is adapted for switching said currents individually applied to said sets of current wires such that the sets are individually provided with a periodic current signal comprising of a phase with a non-zero current and a phase with a zero current, wherein the current signals for the individual sets are displaced in time such that non-negative currents are only present in one current signal at a time. The shape of the current signal is in generally a square wave, however sine, triangular, or saw-tooth wave forms are also possible. The polarity of the non-zero current may be either positive or negative, depending on the specific embodiment as explained below.

Preferably, the current signals provided to said individual sets are identical but displaced in time, wherein the displacement in time correlates with the displacement of the sets of current wires in the direction of transport in such a way that the displacement in time is the largest for the current signals that are provided to the sets that are displaced the farthest.

It was found that the beads will follow the desired direction up to a certain switching frequency. If the switching frequency of the currents provided to the individual current wires is too high, the beads cannot keep up anymore due to the limited velocity they can acquire which is caused by the balance of the magnetic force and the viscous drag. This critical speed/frequency is generally determined experimentally, but there can also be provided presettings for use, for instance as a default, for various beads. In practice, for the most effective transport, it is desired to be at (or just below) this critical switching frequency to obtain the highest possible transport speed.

Generally, the external field is stationary. If use is made of electromagnetic coils to generate it, though, the freedom to control it in time exists. That means that in situations where the current in the wire is switched in direction, the external field direction may be flipped (instead of the current wire direction) to achieve the same effect. In that case, the switching of the external field must be timed properly with the switching between the wire currents.

In this case, i.e. if the external magnetic field is provided by an electromagnet, it if further possible to switch the external magnetic field on only when transport of beads is needed. If no transport of beads is needed the external magnetic field can be switched off to conserve energy. In that case during transport the external magnetic field may be switched on and stationary (and more or less uniform), but over time (i.e. during times when it is switched on and switched off) the external magnetic field may not be considered as being completely stationary in time.

In other preferred embodiments it is possible to select the direction of transport of the beads and/or change the direction of transport of the beads interactively. To achieve this the switching unit is adapted for selecting the polarity of the current signals and/or for switching the polarity of at least one current signal which results in the desired selection or change of the direction of transport of the beads.

To obtain not only a one-dimensional transport of the beads, but to have the freedom of transporting the beads two dimensionally over the transport surface in any desired direction said current wire structure comprises a first group of at least two first sets of meandering current wires arranged on a side of said transport element opposite to said transport surface, said at least two first sets being displaced with respect to each other in at least two directions, and a second group of at least two second sets of meandering current wires arranged on the same side of said transport element, said at least two second sets being displaced with respect to each other in at least two directions, wherein said first group and said second group of current wires are arranged rotated, in particular by 90°, with respect to each other about a rotation axis that is perpendicular to said transport surface.

In other applications it might be desired to let the beads "hop" over the transport surface or even jump in and out of small wells. To achieve this the switching unit is preferably adapted for switching said currents individually applied to said sets of current wires such that the sets are individually provided with a periodic current signal comprising a phase with a positive current and a phase with a negative current, wherein the current signals for the individual sets are displaced in time such that positive and/or negative phases of different current signals, in particular of current signals provided to neighboring current wires, overlap each other. The shape of the current signal is in generally a square wave, however sine, triangular, or saw-tooth wave forms are also possible.

According to another embodiment a set of coils for generating a substantially uniform magnetic field in a direction substantially parallel to the transport surface, and a coil control means for controlling the set of coils to change the direction of the magnetic field within a plane parallel to the transport surface, in particular for flipping the direction of the magnetic field between two opposite directions. Hence, the external magnetic field can be switched in polarity rather than the current driving the wires as provided in other embodiments.

According to another aspect the present invention relates to a drive unit for providing drive currents to a device for transporting magnetic or magnetizable beads over a transport surface according to the present invention. Said drive unit is adapted for individually switching currents individually applied to said sets of current wires according to a current driving scheme resulting in a transport of said beads over said transport surface, wherein said drive unit is adapted for switching said currents such that the sets are individually provided with a periodic current signal comprising of a phase with a non-zero current and a phase with a zero current. Various embodiments exist for the drive unit for controlling the drive currents, in particular for switching the current provided to the current wires, as has been explained above and as will be illustrated with reference to the following figures.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1A:
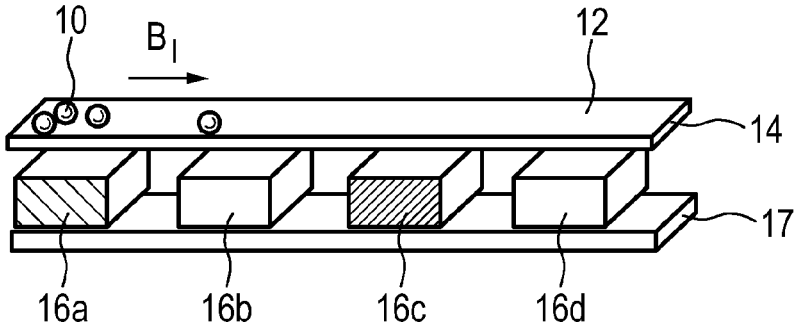
FIG. 1 shows diagrams illustrating the transport of beads of a transport surface by use of current wires.

It is well known, that a single current wire creates a magnetic field that attracts superparamagnetic beads towards the wire. It is therefore possible to transport magnetic beads 10 over a transport surface 12 of a transport element 14 using multiple integrated current wires 16*a*, 16*b*, 16*c*, 16*d* deposited on a substrate 17, as depicted in FIG. 1A. By sequentially addressing the current wires 16*a*, 16*b*, 16*c*, 16*d*, creating local magnetic fields $B_1$, so that the beads 10 are attracted by the respective current wires 16*a*, 16*b*, 16*c*, 16*d*. Therefore they move from left to right over the transport surface 12. As depicted in FIG. 1A, the wires 16*a*, 16*b*, 16*c*, 16*d* may be covered by an isolating film acting as the transport element 14, the top of which being the transport surface 12.

Figure 1B:
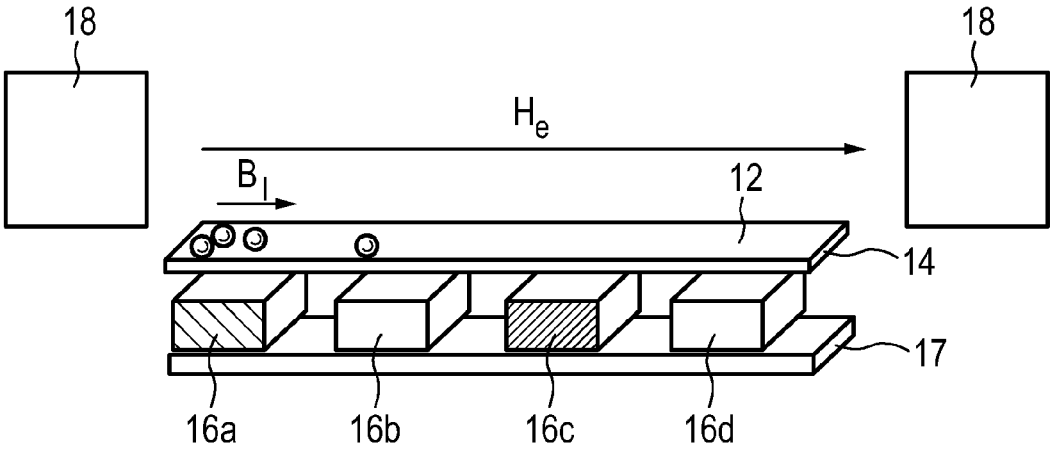

The magnetic force on the beads 10 may be enhanced by applying a uniform magnetic field $H_e$ as shown in FIG. 1B using an external source 18, e.g. a permanent magnet, in addition to the local magnetic fields $B_1$ generated by the current wires 16*a*, 16*b*, 16*c*, 16*d*. The benefit of this external magnetic field $H_e$ is that the (uniform) external magnetic field $H_e$ increases the magnetization of the superparamagnetic beads 10, and thereby increases the speed of the beads 10 significantly, in particular by an order of magnitude. This way of transporting magnetic beads 10 over surfaces is known, and has been used to manipulate magnetic beads 10 in micro-fluidic devices.

Figures 2A, 2B, 2C:
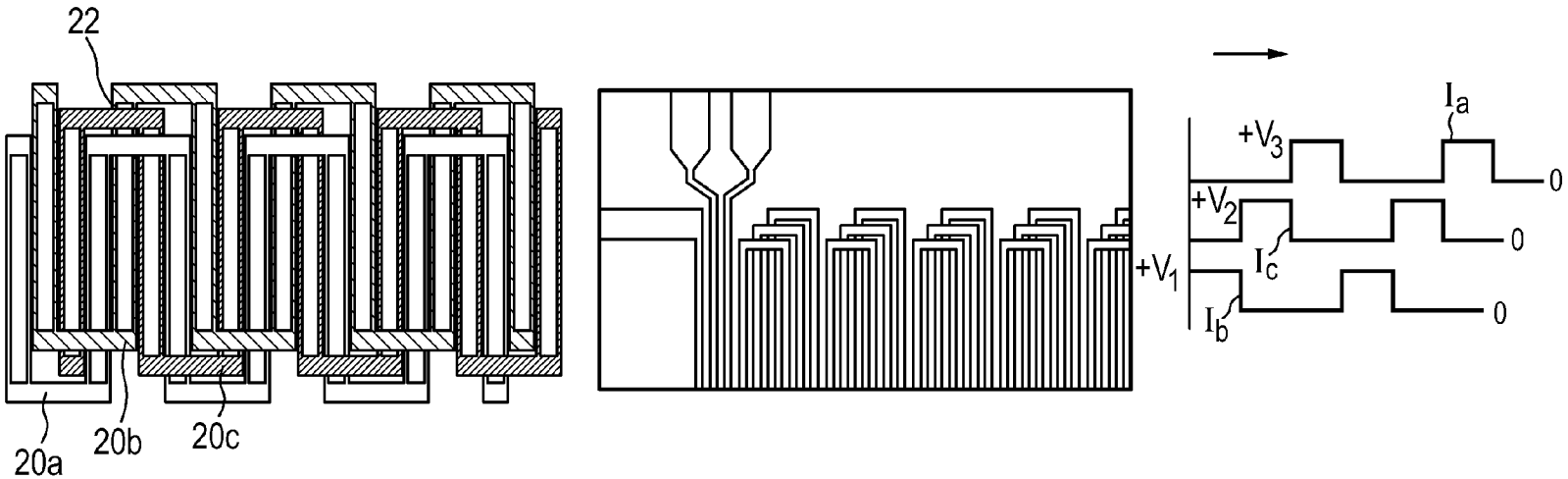
FIG. 2 shows three sets of current wires and an appropriate driving scheme for the current.

Knowing this principle triggers the following proposal for realizing the collective transport of magnetic beads. FIGS. 2A and 2B shows three sets 20*a*, 20*b*, 20*c* of meandering current wires that are deposited on the transport surface. FIG. 2A shows a sketch, FIG. 2B shows an optical micrograph of realized wires (as an example, the wires have a width of 5 μm and a spacing of 1 μm). At the turning points, e.g. the turning point 22, the wires cross over through a "bridge" to avoid an electrical short circuit.

Sequentially and individually addressing the wires of the three sets 20*a*, 20*b*, 20*c* by an appropriate current driving scheme, as shown in FIG. 2C, results in a transport of the beads from left to right over the transport surface. The currents Ia, Ib, Ic shown over time t are respectively provided to the three sets 20*a*, 20*b*, 20*c* of meandering current wires and are controlled such that at a time only one of the currents Ia, Ib, Ic is non-zero, while the other two currents are zero. The advantage of this approach is that only three electrical wires (i.e. the three sets 20*a*, 20*b*, 20*c* of meandering current wires) need to be connected to the outside world.

Figure 3A:
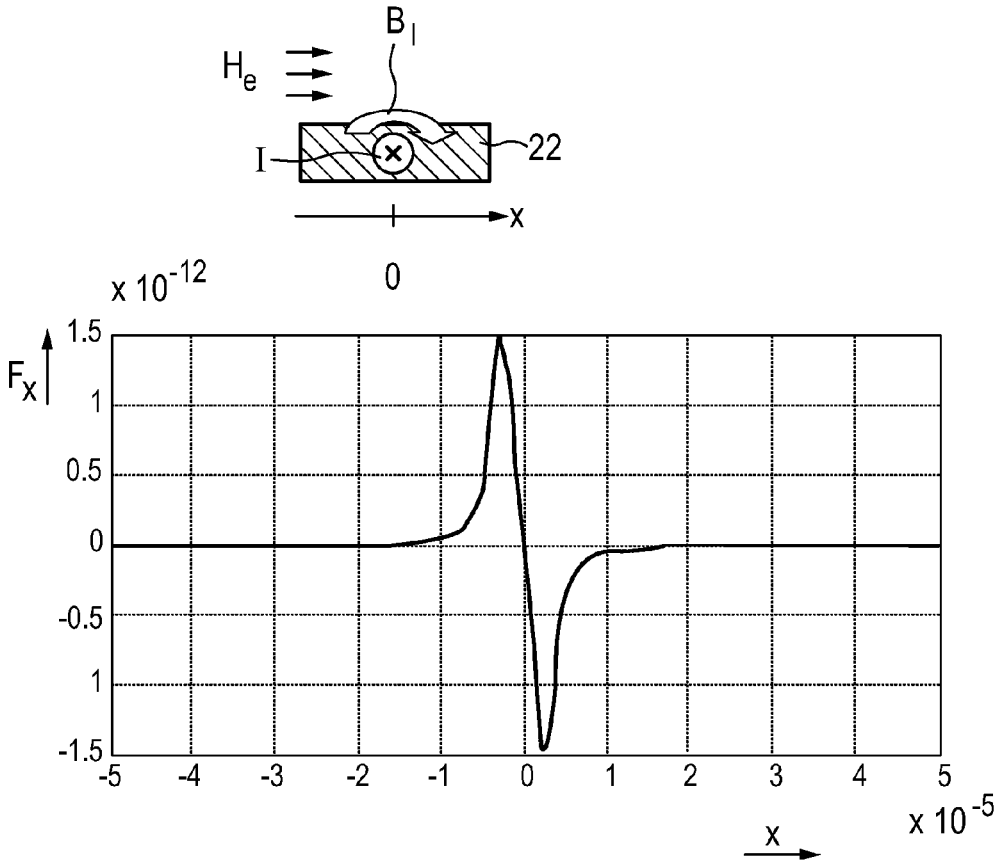
FIG. 3 shows diagrams illustrating the effect of an additional external magnetic field.

This approach works if no additional external magnetic field is applied, which has been proven experimentally. If an external magnetic field is applied, however, the situation is different. In that case, namely, the nature of the magnetic force depends on the orientation of the current through the wire with respect to the direction of the external magnetic field. This can be explained with reference to FIG. 3. FIG. 3A shows a cross section of a current wire 22 where the current I is oriented into the page; that is, the local magnetic field $B_1$ generated by the wire 22 is clockwise. Additionally, an external magnetic field $H_e$ is directed from left to right. As a result of the total magnetic field (external magnetic field plus local magnetic field), a super-paramagnetic bead, positioned at the surface (in this case e.g. 1 μm above the wire 22) would experience a magnetic force $F_x$ as depicted in the diagram of FIG. 3A, as a function of horizontal position x, where location 0 is at the centre of the wire 22. A positive force $F_x$ here means a force in the direction of (positive) x. Thus, the bead is attracted towards the wire 22.

Figure 3B:
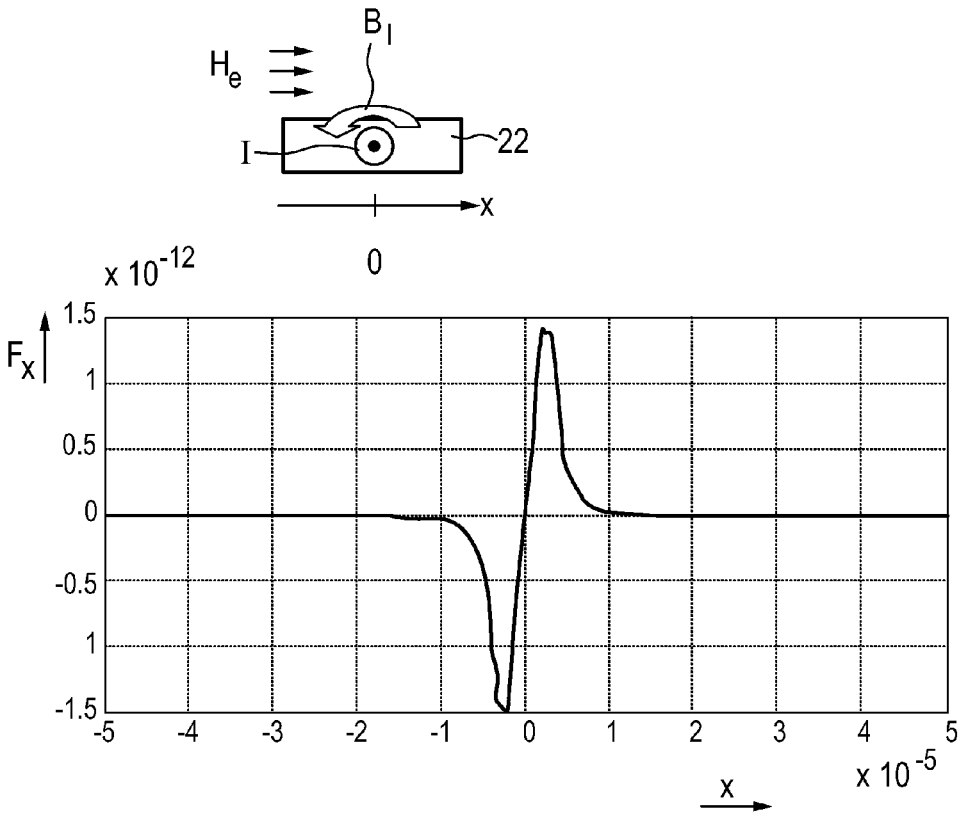

The situation is different when the current I is in the out-of-page direction, as depicted in FIG. 3B. The local magnetic field $B_1$ is now oriented anti-clockwise, and the force is actually repelling the bead away from the wire 22.

This effect has consequences for the working of the device depicted in FIG. 2. Due to the meandering structure of the wires 20*a*, 20*b*, 20*c*, the current (and therefore the local magnetic field orientation) changes at each turn, and changes therefore direction with respect to a stationary uniform external magnetic field. In addition to an external magnetic field, therefore, at each turn the situation changes from that depicted in FIG. 3A to that depicted in FIG. 3B. That is, it changes from attraction to repulsion and vice versa. This means that using the driving scheme depicted in FIG. 2C will not result in the movement of beads from left to right. What will rather happen at each cycle, is that beads will take two steps to the right (from a wire of set 20*a* to the neighboring wire of set 20*b* and from said wire of set 20*b* to the neighboring wire of set 20*c*) and then return back to the original wire of set 20*a* taking a bigger step back. This has also been observed experimentally.

Hence, it is a further recognition of the present invention that the beads can be made to move from into one direction parallel to the transport surface, e.g. from left to right in FIG. 2A, if the current direction is changed at the right moment. This shall be explained in more detail with reference to FIG. 4 which shows a cross-section (FIG. 4A) through a first embodiment of a device 24 according to the present invention, a current wire structure 20 (FIG. 4B) and a current driving scheme (FIG. 4C) for use in this embodiment.

Figure 4A:
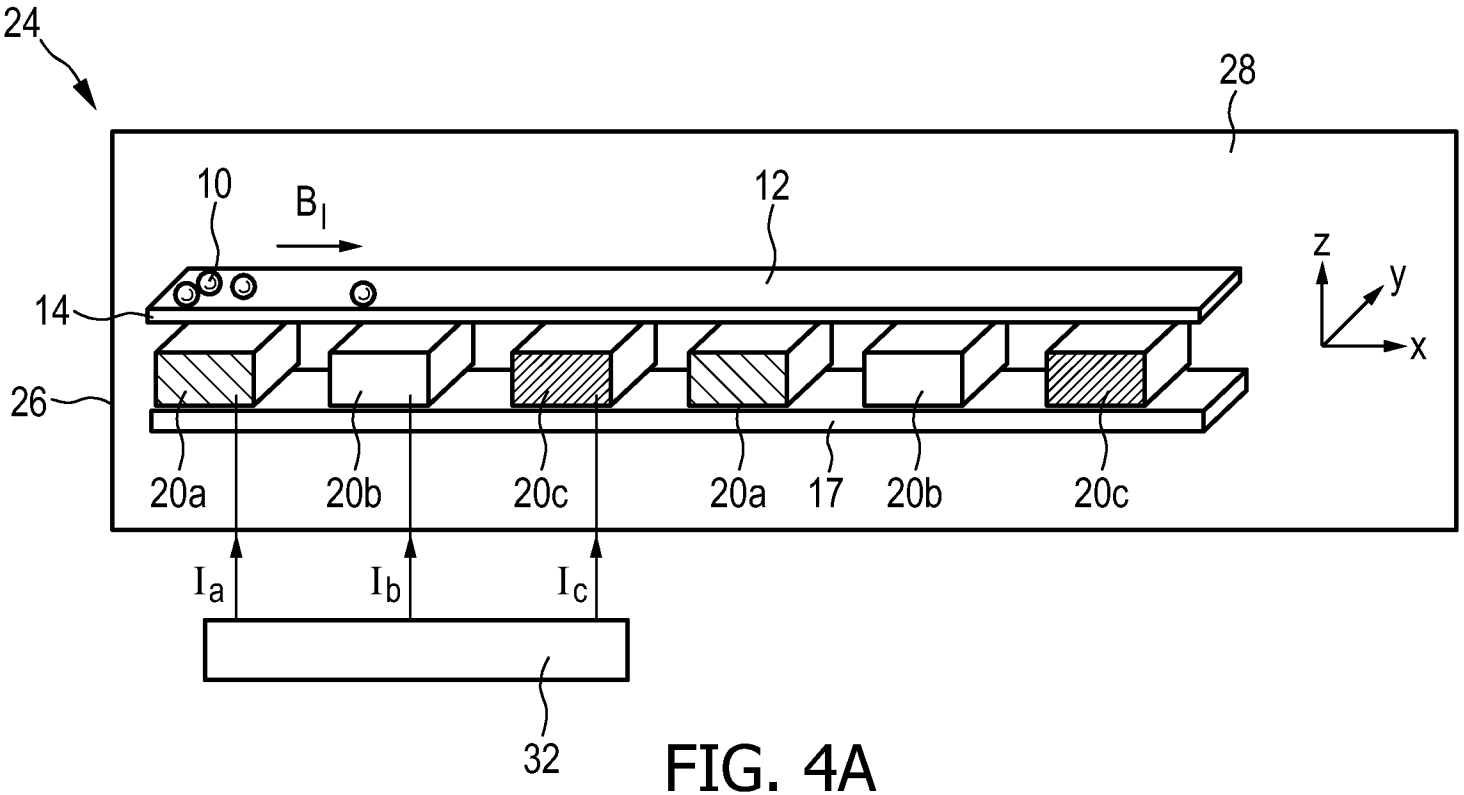
FIG. 4 shows a cross section through a first embodiment of a device according to the present invention including three sets of meandering current wires and an appropriate current driving scheme according to a first embodiment of the present invention.

The device 24 shown in FIG. 4A comprises a chamber 26 comprising magnetic or magnetizable beads 10 in a fluid 28. A transport element 14 including said transport surface 12, over which said beads 10 shall be transported, is arranged within said chamber 26. On a side of said transport element 14 opposite to said transport surface 12 a current wire structure 20 comprising three sets 20*a*, 20*b*, 20*c* of meandering current wires are arranged. As can be seen in FIG. 4B, said three sets 20*a*, 20*b*, 20*c* are displaced with respect to each other in at least two directions, in particular the x- and y-direction forming a wire plane 30 parallel to the transport surface 12.

It should be noted that the substrate 17 could also be replaced by an inner side wall of the chamber 26 so that the current wired are deposited directly on the inner sidewall. Further, the current wires could also be deposited on the outer sidewall of the chamber 26 so that the opposing inner sidewall of the chamber 26 serves as the transport surface.

For generating and individually switching currents Ia, Ib, Ic that are individually applied to said sets 20*a*, 20*b*, 20*c* of current wires according to a current driving scheme a switching unit 32 is provided. Said switching unit 32 can also be regarded as a drive unit for providing drive currents to the current wires.

Figure 4C:
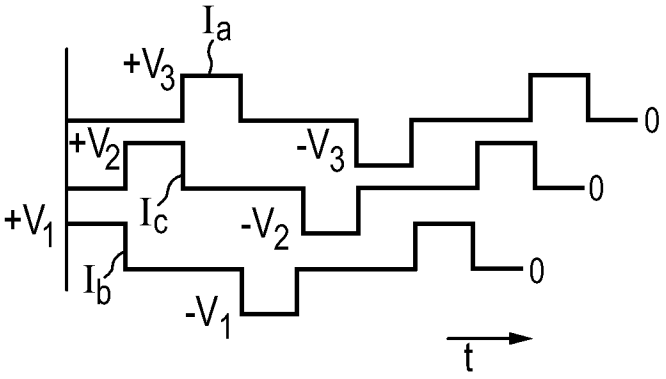
Figure 4B:
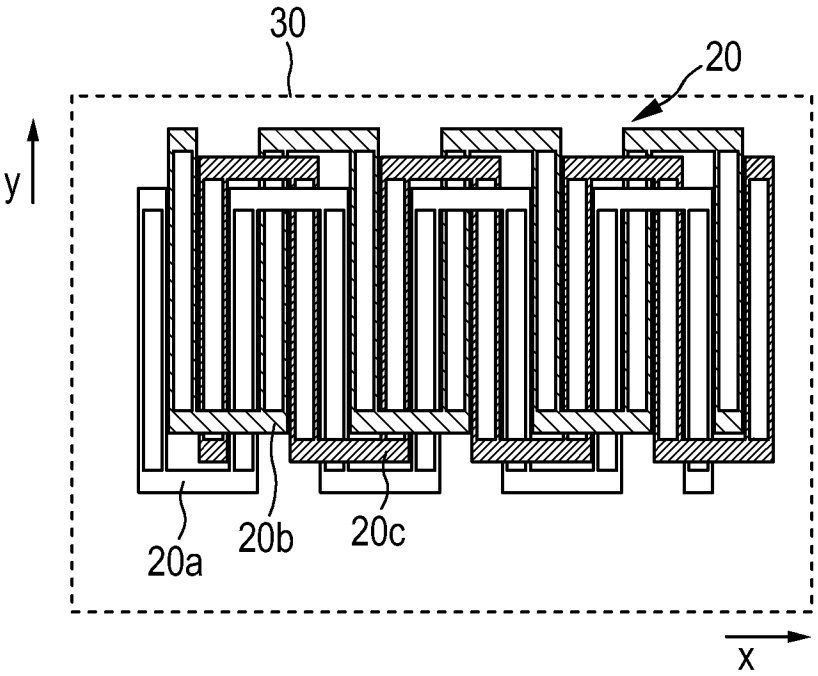

A corresponding driving scheme is shown in FIG. 4C for the three currents Ia, Ib, Ic that are applied to the three sets 20*a*, 20*b*, 20*c* of current wires. By switching the currents Ia, Ib, Ic from positive to negative, the nature of the magnetic force at a particular wire segment is flipped from repulsive to attractive resulting in a transport of said beads 10 over said transport surface 12 in x-direction.

Thus, the dependence of the nature of the magnetic force on the relative orientation of the current and a, in some embodiments additionally provided, stationary uniform external magnetic field can be used advantageously by properly driving the currents.

Exemplarily, some dimensions of elements used according to the present invention shall be given:

The magnetic beads can be magnetizable or magnetic, in particular super-paramagnetic, beads. In a preferred embodiment polymer beads with magnetite nano-particles in them are used. The typical range of sizes is from 0.5 μm to 50 μm, in particular from 1 μm to 20 μm.

The wires are made of a conducting material, preferably metal (e.g. Cu or Al), because of the relatively large current (density) used. The typical width of the wires is from 1 μm to 10 μm. The typical spacing is from 1 μm to 10 μm. The typical thickness is from 0.5 μm to 5 μm. The wires can be produced on a substrate (glass or silicon) in different layers, with existing thin-film deposition and structuring technologies.

The typical currents used are from 5 mA to 100 mA (e.g. between 10 and 30 mA), leading to a circular non-uniform magnetic field created locally around the wire. The typical frequency of switching between the wires is from 0.1 to 10 Hz.

The external magnetic field typically has a field strength in the range of 500 to 5000 Oe (1 Oe=(1000/(4 pi)) A/m), or a magnetic flux B from 50 to 500 mT.

Figure 5A:
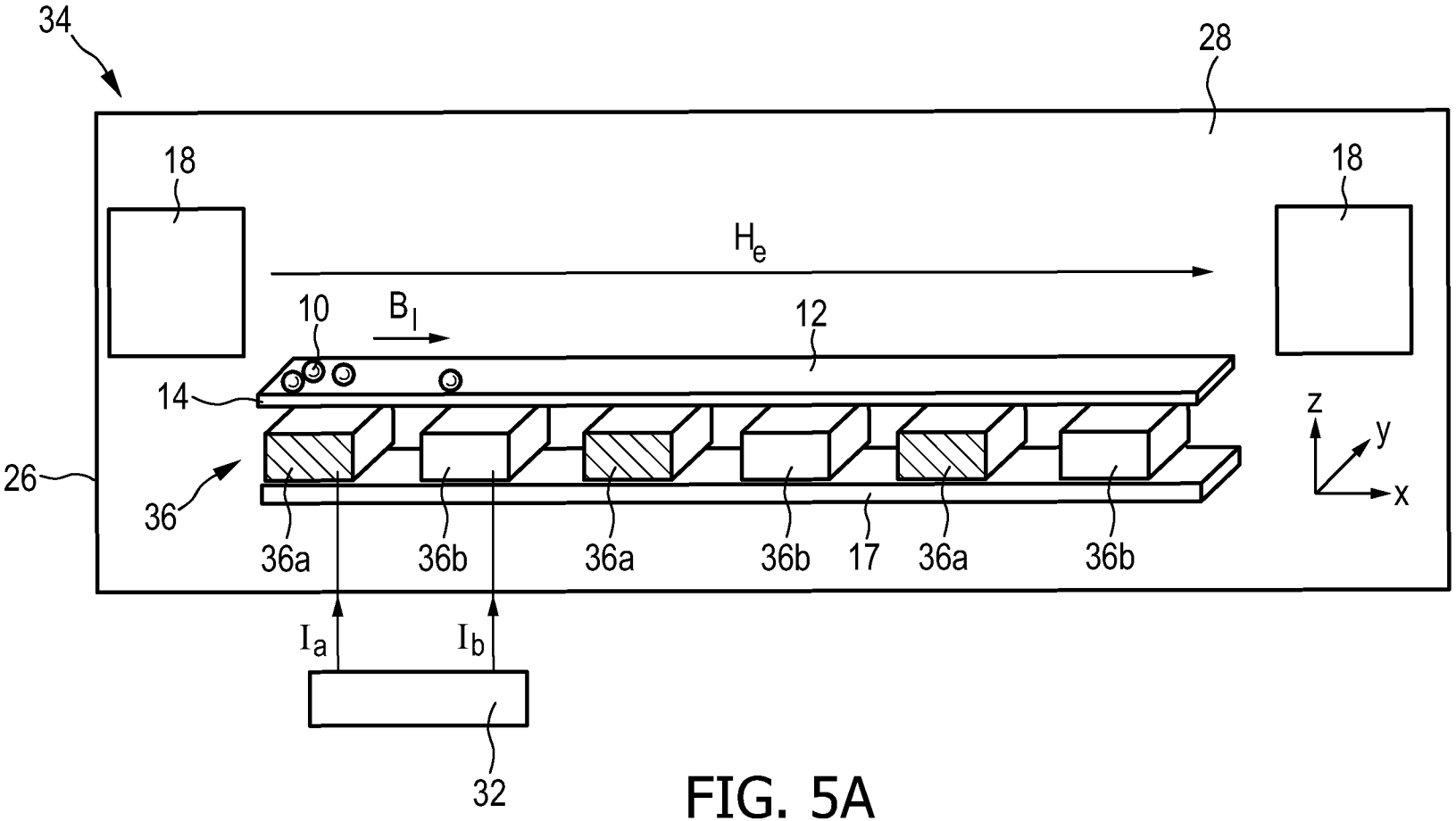
FIG. 5 shows a cross section through a second embodiment of a device according to the present invention including two sets of meandering current wires and an appropriate current driving scheme according to a second embodiment of the present invention.
Figure 5B:
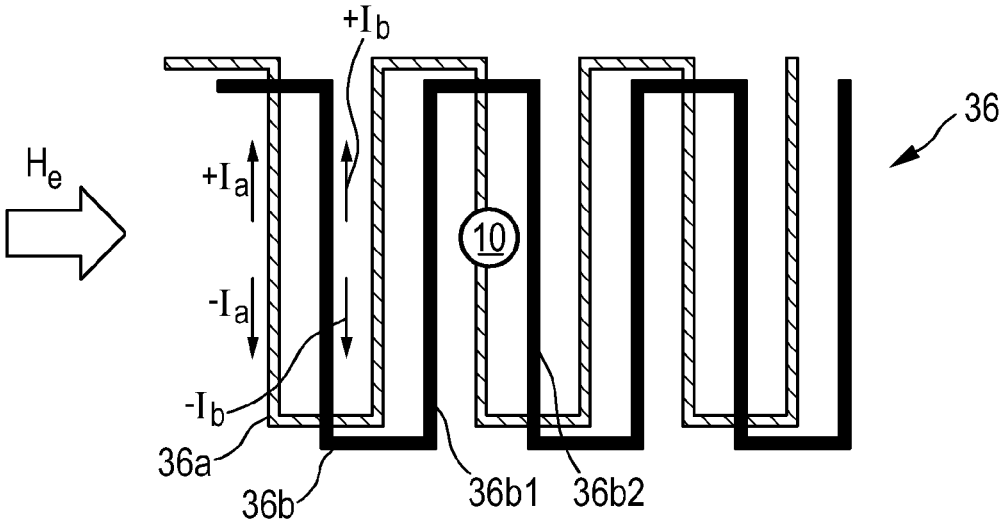
Figure 5C:
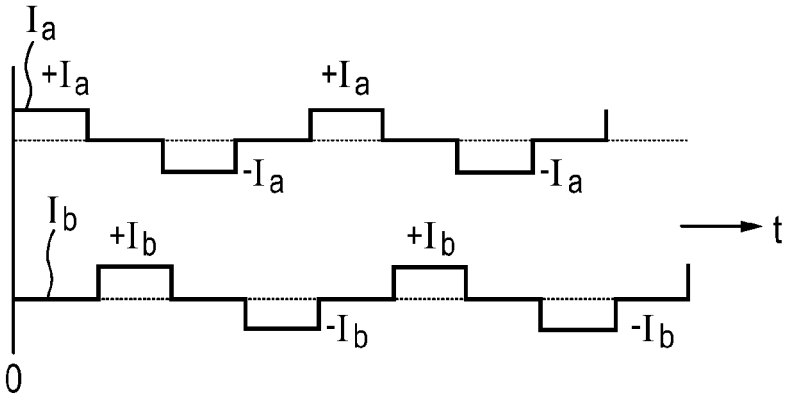

According to another embodiment, as illustrated in FIG. 5, just two sets 36*a*, 36*b* of meandering current wires are used to move the beads 10 in any direction along a line over the transport surface 12. But in addition, a stationary external magnetic field $H_e$ is applied by a an external magnetic source 18, e.g. a permanent magnet, an electro-magnet or a coil arrangement. FIG. 5A shows a cross-section through this embodiment of the device 34, FIG. 5B shows a current wire structure 36 including the two meandering wires 36*a*, 36*b* and the initial position of the bead 10 used in this device 34. FIG. 5C shows a current driving scheme for use in this embodiment, i.e. the driving currents Ia, Ib applied to the wires as a function of time t.

At time zero, the wire 36*a* is "switched on" and the bead 10 is attracted by this wire on which it is positioned, due to the combination of the local magnetic field caused by the positive current +Ia and the stationary external magnetic field $H_e$ according to the principle explained above with reference to FIG. 3. Subsequently, the wire 36*a* is "switched off" and the wire 36*b* is switched on (with a positive current +Ib). The way in which the current Ib and the external magnetic field $H_e$ are oriented, now causes the bead 10 to be repelled by the wire segment 36*b*1 of the wire 36*b* to its left, whereas it is attracted by the wire segment 36*b*2 of the wire 36*b* to its right. The bead 10 therefore moves to the right. Then, the wire 36*b* is "switched off" and the wire 36*a* is "switched on" again, but with the current −Ia flowing in the opposite direction compared to the first step. This causes, again, the bead 10 to move to the right. The subsequent steps, defined by the driving scheme depicted in FIG. 5C, always drive the bead 10 to the right, which has also been proven experimentally.

Figure 6:
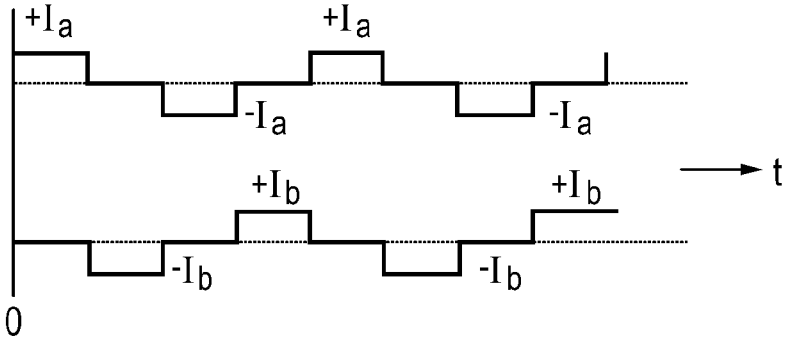
FIG. 6 shows a current driving scheme according to a third embodiment of the present invention.

In a similar way, the bead 10 can be made to move to the left, by a change of driving scheme, as depicted in the diagram shown in FIG. 6. This driving scheme can be applied to the current wire structure 36 shown in FIG. 5B. The difference with the driving scheme shown in FIG. 5C is just the polarity of the current signals Ia, Ib.

Figure 7:
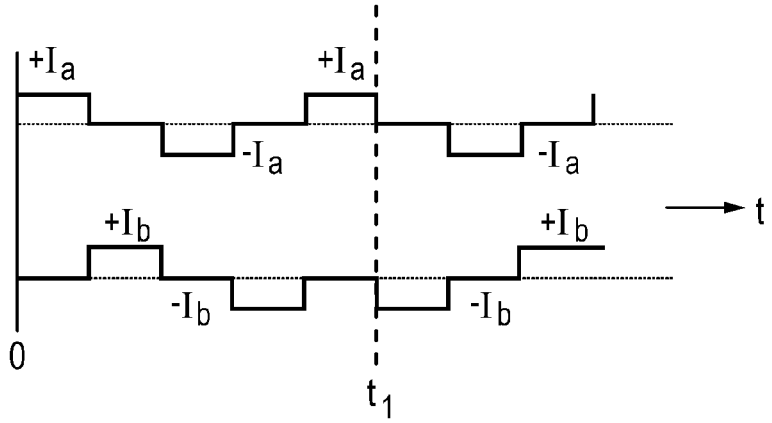
FIG. 7 shows a current driving scheme according to a fourth embodiment of the present invention.

A combination of the driving schemes shown in the previous figures enables the horizontal movement of the bead in any direction along a line perpendicular to the current wire direction, which is shown in FIG. 7. Starting from time zero, the driving scheme is such that the bead 10 moves initially from left to right. At the time t1 however, the polarities of both driving signals Ia, Ib are flipped and the bead 10 starts to move to the left. In fact, at any point in time the direction of movement of the bead 10 can be changed by proper adjustment of the driving scheme.

The average speed of the beads can be modified by changing the switching period of the wires, and by changing the magnitude of the current through the wires. If an adjustable means is used for generating the external fields, for example electromagnetic coils, then bead movement can also be modified by a change of the applied external field.

Figure 8:
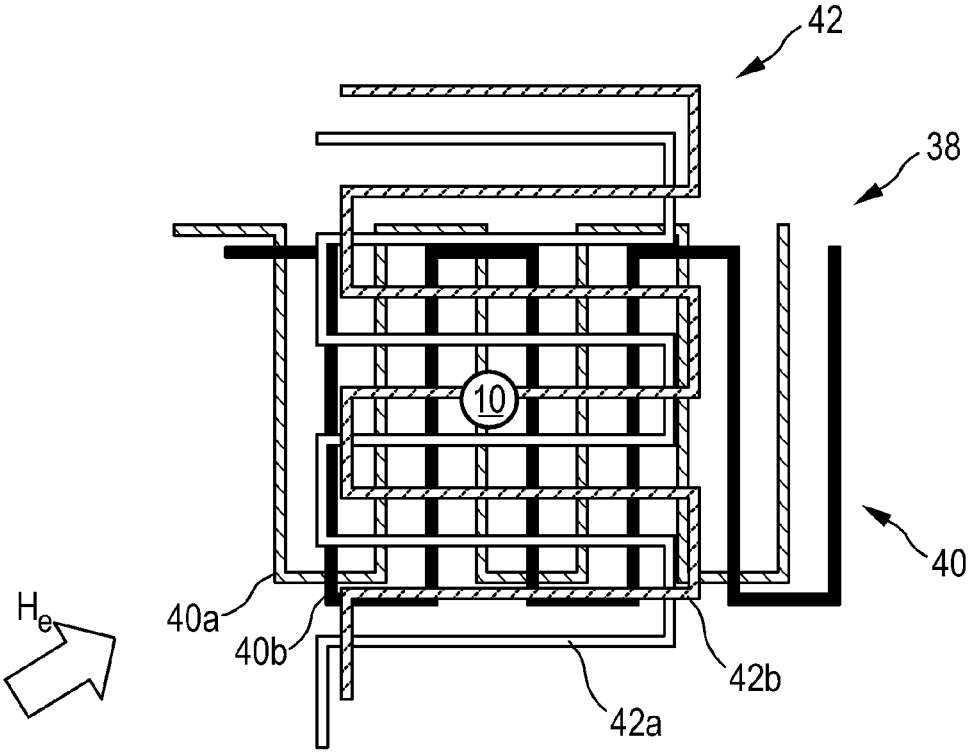
FIG. 8 shows a combination of two pairs of two sets of meandering current wires according to a fifth embodiment of the present invention.

Another embodiment of a current wire structure 38 is shown in FIG. 8. It comprises a combination of two pairs 40, 42 of two sets 40*a*, 40*b* and 42*a*, 42*b* of current wires and a stationary uniform external magnetic field $H_e$. The two pairs 40, 42 are oriented perpendicularly to each other (but other angular displacements than 90° around a rotation axis that is perpendicular to the plane of the two pairs are also possible), which enables the complete freedom of movement of beads 10 over the transport surface. By a proper switching of the driving schemes for the wires, beads 10 can be moved over the transport surface along any trajectory.

Figure 9:
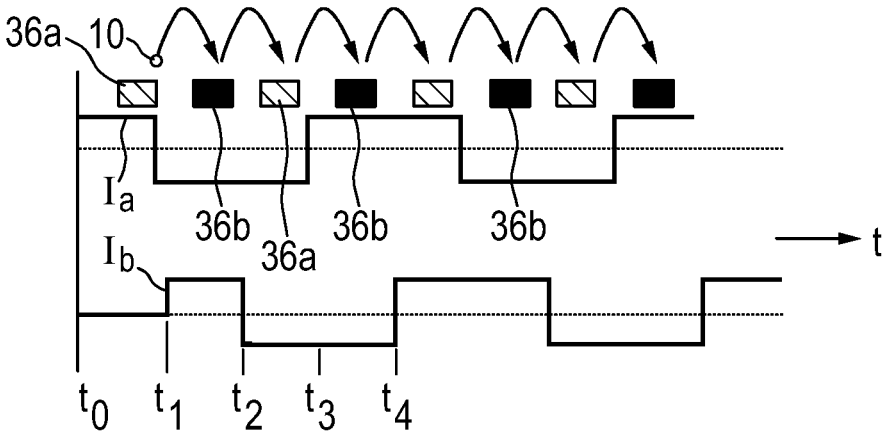
FIG. 9 shows a current driving scheme according to a fifth embodiment of the present invention.

FIG. 9 illustrates an embodiment of a driving scheme that can be used with the embodiment of the current wire structure 36 shown in FIG. 5B, which enables that it may even be possible to force beads 10 to "hop" over a surface or even jump in and out of wells, which is relevant for the sequencing application discussed below. The reason is that in the situation shown in FIG. 3B, the repulsive force does not act in the horizontal direction only, but also in the vertical direction, that is the beads experience a "lift force" away from the transport surface below which the current wire is integrated. The driving scheme shown in FIG. 9 will cause the beads 10 to hop over the transport surface.

At time zero (t0), the wire 36*a* is switched on, and the depicted magnetic bead 10 is attracted by the wire segment on which it is positioned. At time t1, the current direction through the wire 36*a* is changed, which causes the bead 10 to be repelled, i.e. forced upward, away from the surface, from the wire 36*a* it is located at. At the same time, the wire 36*b* i switched on (with a positive current +Ib) which attracts the bead 10 to the right. That means that the bead 10 will "hop" to the right, until it arrives at the closest wire segment of wire 36*b*. Then, at time t2, the current direction in the wire 36*b* is flipped so that the bead 10 is repelled from it. The current Ia in the wire 36*a* is still switched on which, in this case, causes a force acting to the right at the same time. Hence, the bead 10 hops again to the right.

Hence, with the driving scheme shown in FIG. 9, the bead 10 will continue hopping to the right. The direction of the hopping can be changed at any moment in time by changing the polarity of the current through the wire on which the bead is not located at the moment of switching. If the current wires 36*a*, 36*b* are positioned in or underneath micro-wells, it may be possible to let beads jump from one well to a neighboring one.

In all of the embodiments described above, the external field is assumed to be stationary. If use is made of electromagnetic coils to generate it, though, the freedom to control it in time exists. That means that in situations where the current in the wire is switched in direction, e.g. in embodiments 4, 5, 6, 7, 9, the external field direction may be flipped (instead of the current wire direction) to achieve the same effect. In that case, the switching of the external field must be timed properly with the switching between the wire currents.

The concepts explained above are useful for any application in which magnetic beads need to be collectively manipulated over a surface in a controlled way. In particular, if the beads are substrates for DNA strands, the surface may be patterned such that the required reagents for the sequencing steps are organized on the surface in a regular pattern, as depicted in FIG. 10 illustrating a micro-fluidic apparatus 44, in particular a DNA sequencing apparatus, for manipulating a sample containing magnetic or magnetizable beads, in particular for sequencing or nucleic acid testing comprising a device for transporting magnetic or magnetizable beads over a transport surface.

Figure 10:
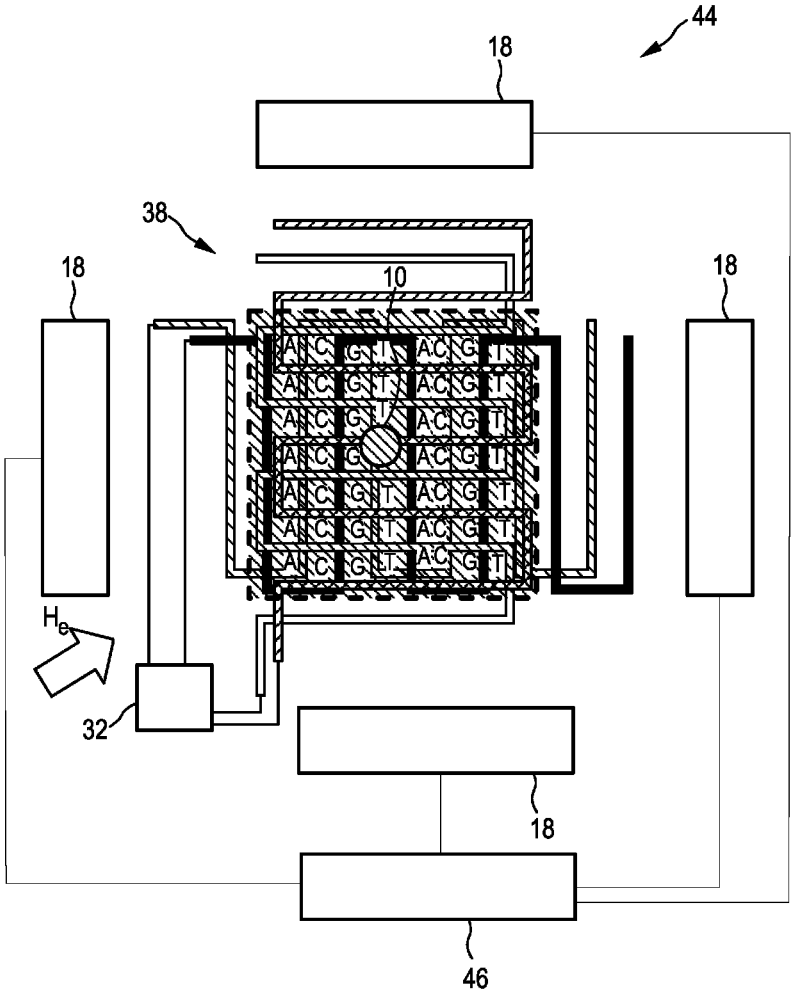
FIG. 10 shows an embodiment of a micro-fluidic system for DNA sequencing according to the present invention.

The embodiment of the apparatus 44 shown in FIG. 10 comprises as wire structure 38 as illustrated in FIG. 8 allowing movement of the beads 10 in any two-dimensional direction. Further, the switching unit 32 for generating and switching the currents for all the sets of meandering current wires 40*a*, 40*b*, 42*a*, 42*b* is shown, as well as the magnetic field generation means 18 for generating (and, preferably, modifying) the external magnetic field $H_e$.

While the magnetic field generation means 18 can generally be permanent magnets, it is preferred in this embodiment that they are implemented by electromagnetic coils so that the magnetic field $H_e$ can be modified. For this purpose a coil control unit 46 is additionally provided by which the control currents for the coils can be controlled. Thus, the direction (and/or strength) of the magnetic field $H_e$ is preferably changeable by the user. Alternatively or in addition also the currents to the meandering current wires can preferably be set or changed by the user through an interface (not shown).

It shall be noted that such coils and coil control means can also be provided in other embodiments where the direction (and/or strength) of the external magnetic field $H_e$ shall be modified.

With such an apparatus, the reagents may be contained in droplets that are arranged on the surface through surface energy patterning of the surface (i.e. in hydrophobic-hydrophilic areas), or they may be present in micro-wells present on the surface. The beads, and hence the DNA strands to be sequenced, can be transported from one sequencing location to the other, and the sequencing reactions may take place. The sequencing approach may be "gyro-sequencing" in which a successful inclusion of a nucleotide generates a fluorescent signal. Through (optical) detection, the process can be recorded, and the DNA sequence deducted. Alternatively the sequencing process could involve the incorporation of fluorescently labeled nucleotides. Further, the sequencing process may be done by nanopore sequencing. In the sequencing process in that case the DNA should be detached from the bead as the bead is too big to pass through the nanopore. Yet transport by beads may be involved in some manner in the device to bring individual strands to the nanopore sequencing unit.

The present invention can thus generally be applied in any (micro-fluidic) system in which beads need to manipulated collectively over a surface in a controlled fashion. In particular, the invention can be applied in DNA sequencing devices to control the sequencing steps involved, as well as sample preparation steps, e.g. steps DNA extraction in nucleic acid testing. Further, the invention can be applied to the magnetic biosensor used for several biochemical assay types.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measured cannot be used to advantage.

Any reference signs in the claims should not be construed as limiting the scope.

The invention claimed is:

1. A device for transporting magnetic or magnetisable beads over a transport surface, comprising:

a chamber containing magnetic or magnetisable beads in a fluid;

a transport element including said transport surface within said chamber over which said beads shall be transported;

a current wire structure including at least three sets of meandering current wires, said at least three sets arranged parallel to said transport surface on a side of said transport element opposite to said transport surface, said at least three sets being displaced with respect to each other parallel to the transport surface and crossed over each other at a plurality of crossing bridge points; and a switching driver configured to individually switch currents individually applied to said sets of current wires according to a current driving scheme such that the sets are individually provided with a periodic current signal comprising of a phase with a non-zero current and a phase with a zero current, wherein the periodic current signals for the individual sets are displaced in time such that non-zero currents are only present in only one set of the current wires at a time to transport said beads over said transport surface.

2. The device according to claim 1, further comprising a permanent magnet external said chamber positioned and configured to generate a stationary substantially uniform magnetic field in a direction substantially parallel to the transport surface.

3. The device according to claim 2, wherein said switching is configured to reverse a polarity of the currents applied to the sets of wires to change the direction of transport of the beads.

4. The device according to claim 1, wherein the periodic current signals provided to said individual sets are identical but displaced in time, wherein the displacement in time correlates with the displacement of the sets of current wires in the direction of transport in such a way that the displacement in time is the largest for the periodic current signals that are provided to the sets that are displaced the farthest.

5. The device according to claim 1, wherein said switching driver is configured to control polarities of the periodic current signals to select the direction of transport of the beads.

6. A device for transporting magnetic or magnetisable beads over a transport surface, comprising:

a chamber comprising magnetic or magnetisable beads in a fluid;

a transport element including said transport surface within said chamber over which said beads shall be transported;

a current wire structure comprising a first group of at least two first sets of meandering current wires arranged on a side of said transport element opposite to said transport surface, said at least two first sets being displaced with respect to each other, and a second group of at least two second sets of meandering current wires arranged on the same side of said transport element, said at least two second sets being displaced with respect to each other, said first group of current wires being arranged rotated by 90° with respect to the second group about a rotation axis that is perpendicular to said transport surface; and a switching driver configured to individually apply a current to said first and second sets of current wires according to a current driving scheme resulting in a transport of said beads over said transport surface.

7. The device according to claim 6 wherein the driving scheme includes a temporally offset periodic current signal applied to the sets of current wires, the periodic current signal including:

a positive phase followed by;

a first zero phase followed by;

a negative phase followed by; and a second zero phase.

8. A device for transporting magnetic or magnetisable beads over a transport surface, comprising:

a chamber configured to receive magnetic or magnetisable beads in a fluid;

a transport element including said transport surface within said chamber over which said beads shall be transported;

a current wire structure comprising at least three sets of meandering current wires, said at least three sets arranged parallel to said transport surface on a side of said transport element opposite to said transport surface, said at least three sets being displaced with respect to each other directions parallel to the transport surface and crossed over each other at a plurality of crossing bridge points; and a switching driver configured to apply currents individually to said sets of current wires according to a current driving scheme which transports the beads over the transport surface such that the sets are individually provided with a periodic current signal comprising:

a phase with a positive current, and a phase with a negative current, wherein the currents applied to the individual sets are displaced in time such that the positive and/or the negative phases applied to neighboring current wires overlap each other.

9. The device according to claim 8, wherein the at least three sets are displaced with respect to each other in at least three spatial directions.

10. A device for transporting magnetic or magnetisable beads over a transport surface, comprising:

a chamber configured to hold magnetic or magnetisable beads in a fluid;

a transport element including said transport surface within said chamber over which said beads shall be transported;

a current wire structure comprising at least three sets of meandering current wires, said at least three sets arranged parallel to said transport surface on a side of said transport element opposite to said transport surface, said at least three sets being displaced with respect to each other parallel to the transport surface and crossing over each other at a plurality of crossing bridge points; and a switching driver configured to individually apply a temporally offset periodic current signal to the sets of current wires to transport the beads over said transport surface, the periodic current signal including:

a positive phase followed by, a first zero phase followed by, a negative phase followed by, and a second zero phase;

wherein the positive and negative phase are temporally offset such that the positive phase is not applied to two or more sets of wires concurrently and the negative phase is not applied to two or more sets of wires concurrently.

11. A device for transporting a microfluid sample containing magnetic or magnetisable beads in a fluid over a transport surface, the device comprising:

a transport element including said transport surface over which the sample containing the beads is transported;

a current wire structure including at least two sets of meandering current wires disposed on a side of a transport element opposite to said transport surface, said at least two sets being displaced with respect to each other in at least two directions;

a driver configured to individually apply periodic current signals to said sets of current wires, the periodic current signal comprising phases with a non-zero current and phases with a zero current, wherein the periodic current signals for the individual sets are displaced in time such that non-zero current phases are only present in one set of current wires at a time.

12. The device according to claim 11, wherein the driver is further configured to apply identical time displaced periodic current signals to said individual sets that, wherein the displacement in time correlates with a spatial displacement of the sets of current wires in a direction of transport in such a way that the displacement in time is the largest for the periodic current signals that are provided to the set of wires that are displaced farthest.

13. The device according to claim 11, wherein the non-zero phases of the periodic current signals include positive current phases and negative current phases.

* * * * *